US006036010A

United States Patent [19]

Seyffert et al.

[11] Patent Number: 6,036,010

[45] Date of Patent: Mar. 14, 2000

[54] GAME BALL DISPLAY BOX AND METHOD FOR ASSEMBLING SAME

[75] Inventors: Ryan Seyffert, Franklin, Mass.; Armand Carpentier, Orlando, Fla.

[73] Assignee: Sports Licensing, Inc., Hanover, N.H.

[21] Appl. No.: 09/314,215

[22] Filed: May 19, 1999

Related U.S. Application Data

[60] Provisional application No. 60/088,830, Jun. 10, 1998.

[51] Int. Cl.[7] ..... B65D 85/00

[52] U.S. Cl. ..... 206/315.9; 206/782; 206/780

[58] Field of Search ..... 206/757, 779, 206/780, 782, 315.9; 229/121

[56] References Cited

U.S. PATENT DOCUMENTS 3,815,735 6/1974 Cucuo ..... 206/485
3,987,893 10/1976 Hanson ..... 206/45.14
4,452,355 6/1984 Benham ..... 206/45.31
4,773,539 9/1988 Nock ..... 206/418
5,322,210 6/1994 Chila et al. ..... 229/8
5,702,002 12/1997 Harrison et al. ..... 206/782

*Primary Examiner*—David T. Fidei
*Attorney, Agent, or Firm*—Brian M. Dingman

[57] ABSTRACT

A display box for a game ball, comprising, at least three side panels, wherein each side panel is integrally connected to at least one other of the side panels along a vertical seam interposed between the connected side panels; each side panel comprising, at least one central panel and at least two end panels, wherein each end panel is integrally connected to the central panel along a horizontal seam; wherein each end panel comprises, at least one support panel and at least two corner panels; wherein each of the corner panels is integrally connected to the support panel along a transverse seam; and a method for assembling the same.

14 Claims, 4 Drawing Sheets

GAME BALL DISPLAY BOX AND METHOD FOR ASSEMBLING SAME

This application claims the benefit of U.S. Provisional No. 60/088,830 filed Jun. 10, 1998.

FIELD OF THE INVENTION

This invention relates to display boxes for game balls and a method for assembling the display box.

BACKGROUND OF THE INVENTION

Purchasers typically like to see and touch any item that they purchase. This is especially true for game balls and more specifically, soccer balls. The quality of a game ball is highly dependent on materials and workmanship which are best determined by actually touching the ball. To accommodate these purchasing habits, several game balls are usually shipped in a single box or bag to retailers and then displayed loose in a large basket or on an angled shelf. In addition to damage caused during shipment and while on display, shipping and displaying game balls by these methods is imprecise and not particularly attractive from a marketing point of view. Moreover, by displaying the game balls loose in a basket or on a shelf invites people to bounce and throw the game balls in the store, creating a nuisance and possibly a hazard.

SUMMARY OF THE INVENTION

It is therefore a primary object of this invention to provide a display box that is inexpensive to manufacture and easy to assemble into a final package that is pleasing to the eye and thus draws attention to the product.

It is a further object of this invention to provide a unique display box in which the object display appears to be suspended in air.

It is a further object of this invention to provide a display box for a game ball in which the game ball, when stored in the box, can be viewed from the outside of the box.

It is a further object of this invention to provide a display box for a game ball in which the game ball, when stored in the box, may be seen and touched without having to open the display box.

It is a further object of this invention to provide a display box for a game ball in which the game ball is held securely in place in the box without the need for extraneous packing materials to keep the ball from bouncing around in the box.

It is a further object of this invention to provide a display box for a game ball in which the game ball is held securely in an upright position in the box and may be seen and touched without having to open the display box.

It is a further object of this invention to provide a method for assembling a display box for a game ball in which the game ball appears to be suspended in air.

It is a further object of this invention to provide a method for assembling a display box for a game ball in which the game ball is held securely in place in the box without using extraneous packing materials or inserts to keep the ball from bouncing, rotating or otherwise moving around in the box.

A preferred embodiment of the display box of this invention for a game ball, comprises: at least three side panels, wherein each side panel is integrally connected to at least one other of the side panels along a vertical seam interposed between the connected side panels; each side panel comprising, at least one central panel and at least two end panels, wherein each end panel is integrally connected to the central panel along a horizontal seam; wherein each end panel comprises, at least one support panel and at least two corner panels; wherein each of the corner panels is integrally connected to the support panel along a transverse seam. Each of the side panels preferably comprises a large opening through the side panel for viewing and touching a game ball when enclosed with the display box.

The corner panels of the end panels preferably have concave outer edges adapted to support the game ball on the edges in a suspended-like position substantially equidistant between at least two of the side panels.

The display box preferably comprises at least four side panels, wherein the central panel of the side panels has a square-shaped perimeter and wherein at least one of the side panels further comprises one or more tabs integrally connected to the side panel along a vertical seam. Each side panel may include an upper tab; a middle tab; and a lower tab; wherein each of the upper and lower tabs is connected to one of the end panels and the middle tab is connected to the central panel.

Another preferred embodiment of the display box of the invention for a game ball, comprises: at least three side panels, wherein each side panel is integrally connected to at least one other of the side panels along a vertical seam interposed between the connected side panels, wherein at least one of the side panels comprises one or more tabs extending outward from a vertical edge of the side panel; each side panel comprising, at least one central panel and at least two end panels, wherein each end panel is integrally connected to the central panel along a horizontal seam; wherein each end panel comprises, at least one support panel and at least two corner panels; wherein each of the corner panels is integrally connected to the support panel along a transverse seam and wherein one or more of the corner panels has a concave outer edge, wherein the concave edges are adapted to support the ball on the edges in a suspended-like position substantially equidistant between at least two of the side panels.

At least one of the side panels may further comprise an opening through the side panel, although preferably all of the side panels comprise an opening through the central panel of each side panel.

The preferred method of the invention for assembling a display box for a game ball, comprises the steps of: providing at least four side panels, wherein each side panel is integrally connected to at least one other of the side panels along a vertical seam interposed between the connected side panels, wherein at least one of the side panels is provided with one or more tabs, wherein each side panel comprises, at least one central panel and at least one end panel on two opposing ends of the central panel, wherein each end panel is integrally connected to the central panel along a horizontal seam; wherein each end panel comprises, at least one support panel and at least two corner panels; wherein each of the coner panels is integrally connected to the support panel along a transverse seam and has a concave outer edge; folding the side panels along the vertical seams and fixing the one or more tabs to an adjacent side panel to form an elongated four-sided tube so that each the corner panel of each side panel is adjacent to at least one corner panel of another side panel along at least one of the vertical seams; on one of the opposing ends of each of the central panels, pressing inward and down on the vertical seams connecting two adjacent corner panels, thereby inverting each of the corner panels so that each of the vertical seams connecting the adjacent corner panels is folded inward on itself towards an inside corner of the elongated four-sided tube; turning the elongated four-sided tube over; placing the game ball inside the tube so that the ball rests on the concave edges of the inverted corner panels; on the other of the opposing ends of each of the central panels, pressing inward and down on the vertical seams connecting two adjacent corner panels, thereby inverting each of the corner panels so that each of the vertical seams connecting the adjacent corner panels is folded inward on itself towards an inside corner of the elongated four-sided tube; so that the concave edges of the corner panels are flush against the game ball and so that the ball is fixed in a suspended-like position substantially equidistant between at least two of the side panels.

It is envisioned that the display box and method of the invention may be adapted to display all types of game balls and is not limited to a square display box.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The display box of the invention for a game ball generally comprises a single piece of cardboard made up of four side panels connected together by three vertical seams, each side panel having a central panel and two opposing end panels, and each end panel having a support panel and two opposing corner panels having concave edges. When the box is unassembled, the four panels are side-by-side in a row so that the two inner panels are connected adjacent to each other along a vertical seam and to one of the outer panels, respectively, along two more vertical seams. Each end panel is connected to its respective central panel along a horizontal seam. Each corner panel is connected to its respective support panel along a curved, transverse seam. One of the outer side panels is provided with three tabs extending outward from the outer edge of the panel along the central panel and each end panel, respectively.

The display box is assembled by folding the side panels along the vertical seams and fixing the tabs of the one outer panel to the other outer panel with an adhesive. When the adhesive is dry, the corner panels of the end panels on one end of the box are pressed inward and down to invert the corners at one end. The box is turned over and the ball placed on the concave edges of the inverted corners. When the ball is in place, the corner panels of the open end of the box are then pressed inward and down so that all eight inverted corners of the box are flush against the ball along the concave edges of each corner panel. When the display box is fully assembled the ball appears to be suspended within the box substantially equidistant from all eight interior sides of the display box.

Figure 1:
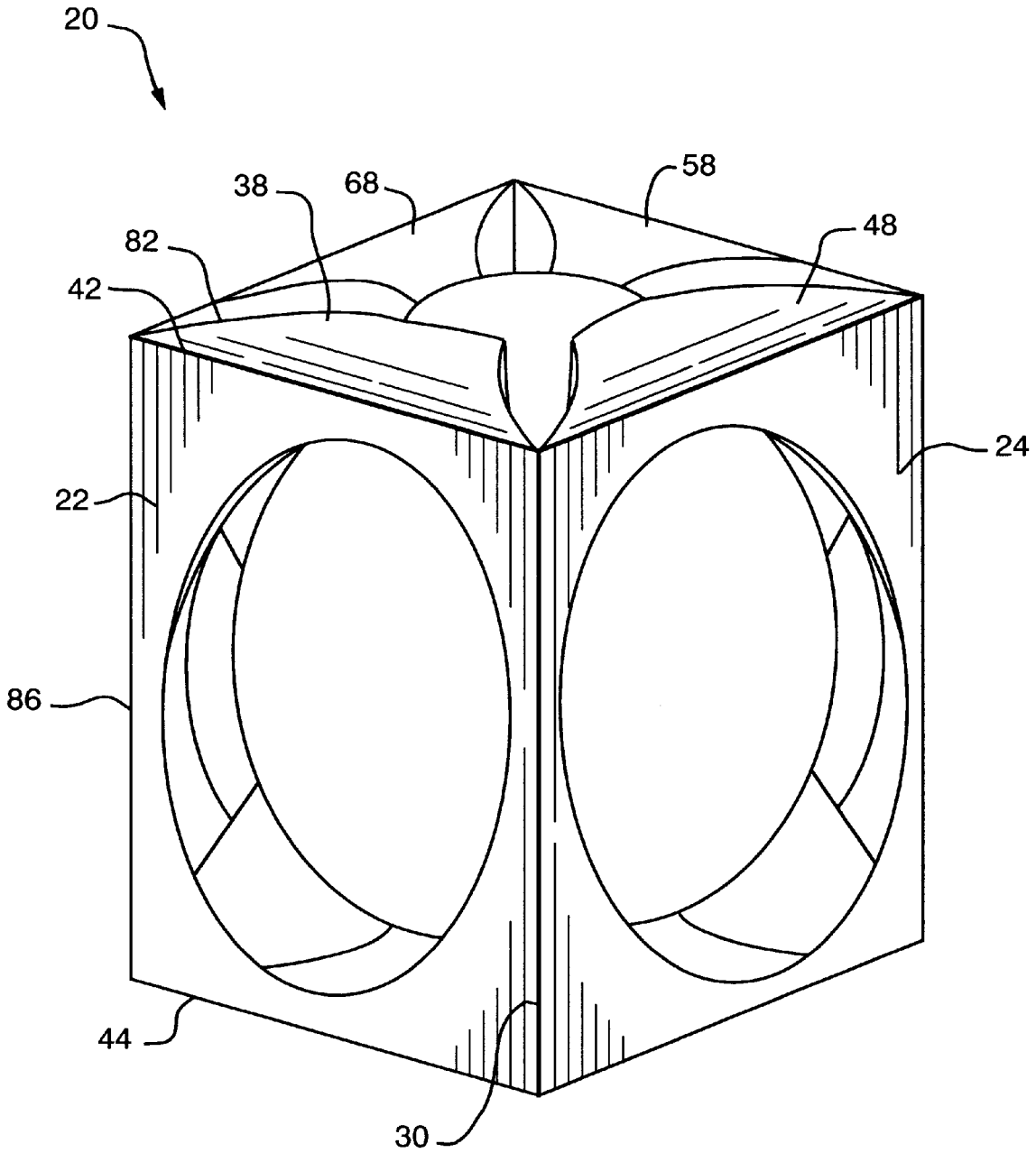
FIG. 1 is a perspective view of a preferred embodiment of the display box of the invention fully assembled with a game ball enclosed therein.
Figure 2:
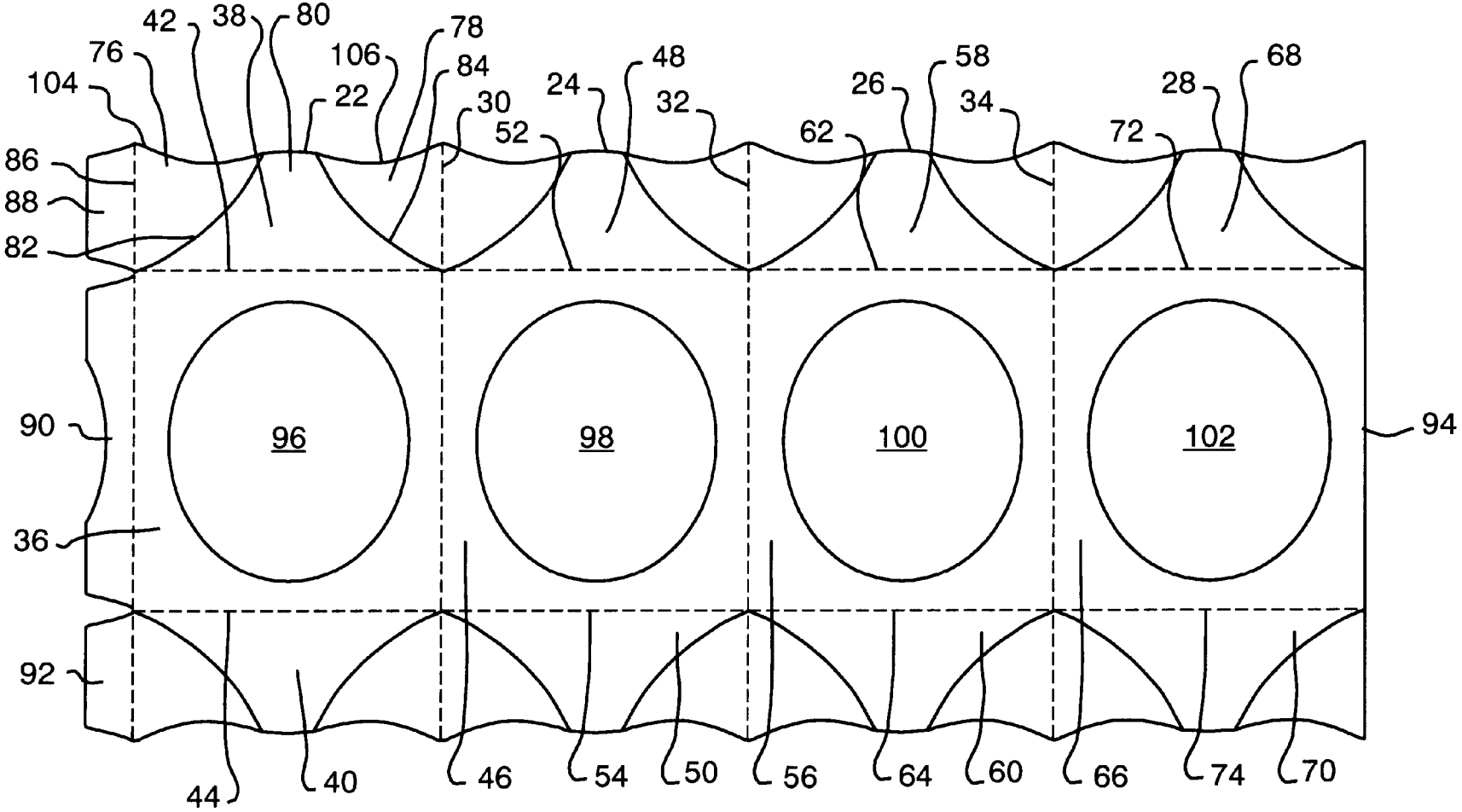
FIG. 2 is a top view of the preferred embodiment of FIG. 1 unassembled.

The details of a preferred embodiment of the game ball display box of this invention are shown in the drawings. Specifically, FIG. 1 shows a preferred embodiment of the display box fully assembled with a ball therein. FIG. 2 is the display box unassembled. Display box 20 comprises side panels 22, 24, 26 and 28 which are integral with one another along vertical seams 30, 32 and 34. Each side panel is made up of three smaller panels, a central panel and two end panels. A round opening or window is cut or punched out of the central panel of each side panel to form circles 96, 98, 100 and 102. The end panels of each side panel are integral with their corresponding central panel along two horizontal seams.

Side panel 22 includes central panel 36 and end panels 38 and 40. End panels 38 and 40 are integrally connected to central panel 36 along horizontal seams 42 and 44, respectively. Side panel 24 includes central panel 46 and end panels 48 and 50. End panels 48 and 50 are integrally connected to central panel 46 along horizontal seams 52 and 54, respectively. Side panel 26 includes central panel 56 and end panels 58 and 60. End panels 58 and 60 are integrally connected to central panel 56 along horizontal seams 62 and 64, respectively. Side panel 28 includes central panel 66 and end panels 68 and 70. End panels 68 and 70 are integrally connected to central panel 66 along horizontal seams 72 and 74, respectively.

Each end panel is made up of three smaller panels. For example, end panel 38 is made up of corner panels 76 and 78 and support panel 80. Corner panels 76 and 78 are integrally connected to support panel 80 along transverse seams 82 and 84. Each corner panel is slightly concave along its outer edge, e.g. edges 104 and 106. These concave edges serve to support a ball in a suspended-like position within the center of the display box when completely assembled.

Side panel 22 further includes three tabs integrally connected therewith along vertical seam 86. These three tabs are upper tab 88, middle tab 90 and lower tab 92. Tabs 88, 90 and 92 are not connected to each other.

Figure 3:
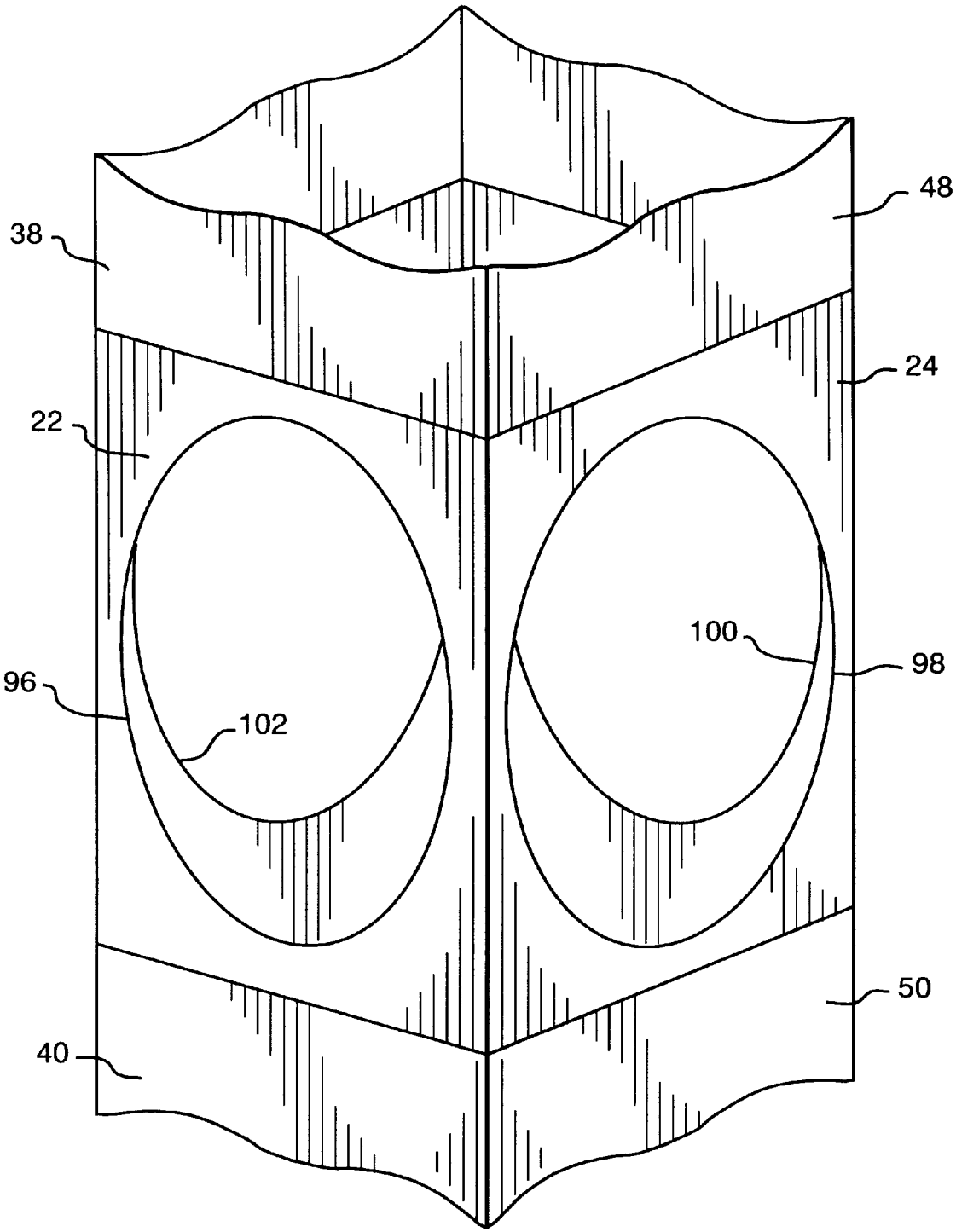
FIG. 3 is a perspective view of the preferred embodiment of FIG. 2 partially assembled.

To assemble display box 20 fold along vertical seams 30, 32 and 34 so that side panels 22 and 28 meet along vertical seam 86 and edge 94 to form an elongated tube with a square cross-section and four circular openings on center panels 36, 46, 56 and 66. Affix the outer surface of tabs 88, 90 and 92 to the inside surface of side panel 28 along so that edge 94 is flush with vertical seam 86, thereby creating another transverse seam 96. The tabs are preferably fixed to side panel 28 with an adhesive, although other means such as adhesive tape or staples may also be used. FIG. 3 illustrates display box 20 partially assembled thus far.

Figure 4:
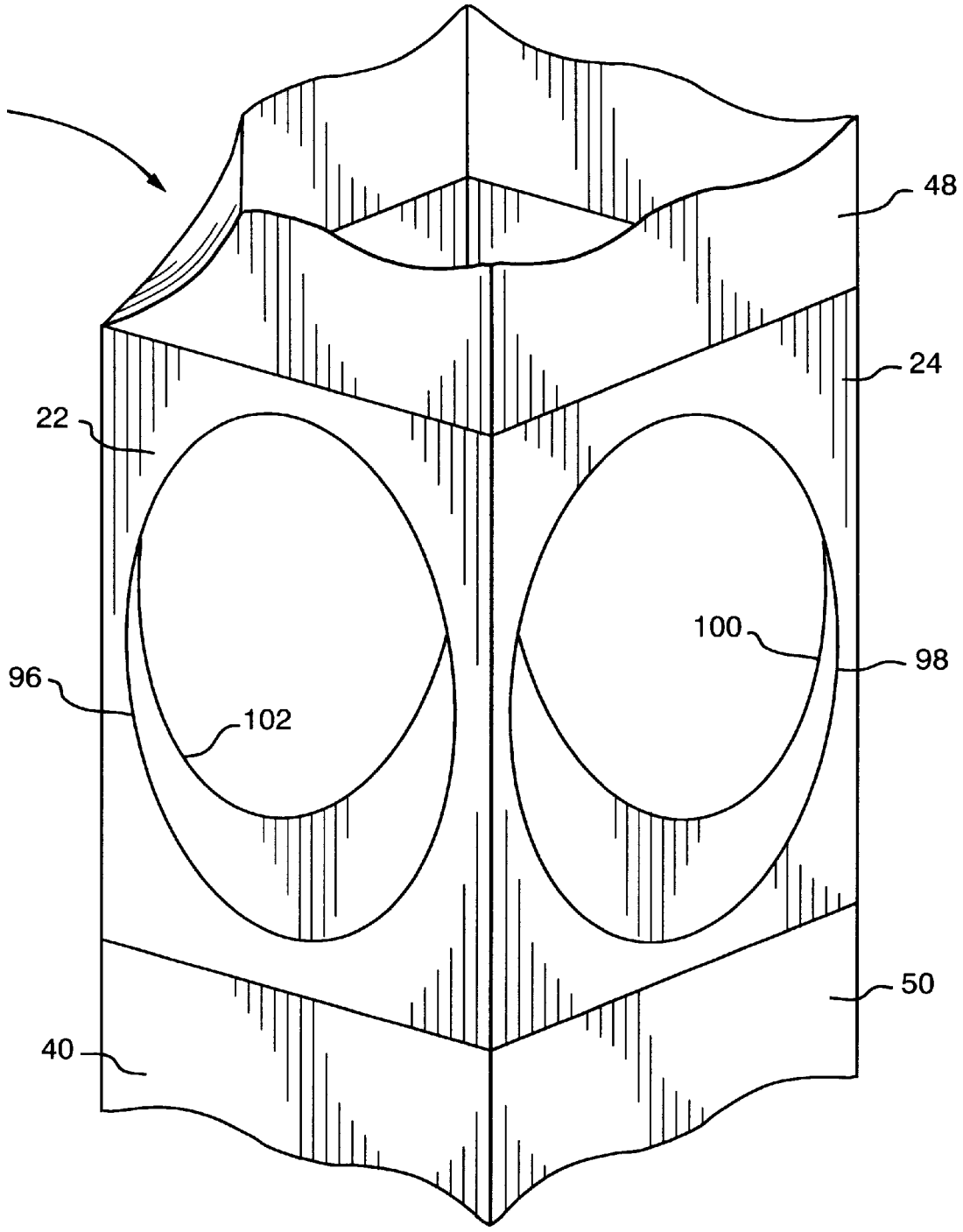
FIG. 4 is perspective view of the preferred embodiment of FIG. 3 assembled one step further.

After the adhesive is set, press inward and down on the outside surface of vertical seams 30, 32, 34 and 86 between adjacent corner panels, e.g. corner panels 76 and 78 (as shown in FIG. 4) to invert each corner so that the inside surface of the vertical seams, e.g. 86 and 30, are folded down towards the inside corners of the square tube along the same vertical seams, respectively. After all four upper corners of the square tube are inverted, turn the tube over and place the game ball inside the tube so that the ball rests on the concave edges of the corner panels, e.g. edges 104 and 106, now facing inwards towards the center of the tube.

Repeating the same motions above, press inward and down on the outside surface of seams 30, 32, 34 and 86 along the corner panels on the bottom side of display box 20 to invert the bottom corners so that the concave edges of the bottom corner panels are pressed flush against the surface of the game ball. More force will be needed to press the bottom corner panels inwards. As all four corners are being pressed inward simultaneously, a pressure point will be reached when the corners "give way" to the curvature of the game ball to lock into place. The pressure of the game ball against all sixteen concave edges of the top and bottom comer panels holds the ball firmly in place in the center of display box 20, thereby holding the ball in a seemingly suspended manner as shown in FIG. 1.

Display box 20 may be opened by pulling upward on any one of the end panels. The pressure from the folds in the ends of display box 20 will cause the ends to release suddenly when the above described pressure point is again reached in the reverse direction when pulling upward on the end panels.

Although the preferred embodiment of the display box is cardboard or paperboard, other suitable materials may be used. In addition, neither the overall shape and size of the display box of the invention nor the holes cut into the side panels or ends are limited to the overall shape or dimensions of the preferred embodiment. The shape and size will be determined by the size and types of the ball. In addition, words, colors, designs or other types of graphics may be applied to the outside or inside of the display box as desired. The number of side panels is also not limited to the four panels of the preferred embodiment. The box may comprise as few as three side panels to form a prism-shape display box. The box may also comprise many side panels to form a display box having many sides.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A display box for a game ball, comprising, at least three side panels, wherein each side panel is integrally connected to at least one other of said side panels along a vertical seam interposed between said connected side panels; each side panel comprising, at least one central panel and at least two end panels, wherein each end panel is integrally connected to said central panel along a horizontal seam; wherein each end panel comprises, at least one support panel and at least two corner panels; wherein each of said corner panels is integrally connected to said support panel along a transverse seam.

2. The display box of claim 1, wherein at least one of said side panels further comprises an opening through said side panel.

3. The display box of claim 2, wherein said opening is round.

4. The display box of claim 1, wherein one or more of said corner panels has a concave outer edge, wherein said concave edges are adapted to support said ball on said edges in a suspended-like position substantially equidistant between at least two of said side panels.

5. The display box of claim 1, comprising at least four side panels.

6. The display box of claim 5, wherein said central panel of said side panels has a square-shaped perimeter.

7. The display box of claim 1, wherein at least one of said side panels further comprises one or more tabs integrally connected to said side panel along a vertical seam.

8. The display box of claim 7, wherein said tabs each comprise, an upper tab;

a middle tab; and a lower tab;

wherein each of said upper and lower tabs is connected to one of said end panels and said middle tab is connected to said central panel.

9. A display box for a game ball, comprising, at least three side panels, wherein each side panel is integrally connected to at least one other of said side panels along a vertical seam interposed between said connected side panels, wherein at least one of said side panels comprises one or more tabs extending outward from a vertical edge of said side panel; each side panel comprising, at least one central panel and at least two end panels, wherein each end panel is integrally connected to said central panel along a horizontal seam; wherein each end panel comprises, at least one support panel and at least two corner panels; wherein each of said corner panels is integrally connected to said support panel along a transverse seam and wherein one or more of said corner panels has a concave outer edge, wherein said concave edges are adapted to support said ball on said edges in a suspended-like position substantially equidistant between at least two of said side panels.

10. The display box of claim 9, wherein at least one of said side panels further comprises an opening through said side panel.

11. The display box of claim 9, comprising at least four side panels.

12. The display box of claim 11, wherein each of said side panels further comprises an opening through said side panel.

13. The display box of claim 9, wherein said central panel of said side panels has a square-shaped perimeter.

14. A method for assembling a display box for a game ball, comprising the steps of, providing at least four side panels, wherein each side panel is integrally connected to at least one other of said side panels along a vertical seam interposed between said connected side panels, wherein at least one of said side panels is provided with one or more tabs, wherein each side panel comprises, at least one central panel and at least one end panel on two opposing ends of said central panel, wherein each end panel is integrally connected to said central panel along a horizontal seam; wherein each end panel comprises, at least one support panel and at least two corner panels; wherein each of said corner panels is integrally connected to said support panel along a transverse seam and has a concave outer edge;

folding said side panels along said vertical seams and fixing said one or more tabs to an adjacent side panel to form an elongated four-sided tube so that each said corner panel of each side panel is adjacent to at least one corner panel of another side panel along at least one of said vertical seams;

on one of said opposing ends of each of said central panels, pressing inward and down on said vertical seams connecting two adjacent corner panels, thereby inverting each of said corner panels so that each of said vertical seams connecting said adjacent corner panels is folded inward on itself towards an inside corner of said elongated four-sided tube;

turning said elongated four-sided tube over;

placing said game ball inside said tube so that said ball rests on said concave edges of said inverted corner panels;

on said other of said opposing ends of each of said central panels, pressing inward and down on said vertical seams connecting two adjacent corner panels, thereby inverting each of said corner panels so that each of said vertical seams connecting said adjacent corner panels is folded inward on itself towards an inside corner of said elongated four-sided tube; so that said concave edges of said corner panels are flush against said game ball and so that said ball is fixed in a suspended-like position substantially equidistant between at least two of said side panels.

* * * * *